US007601047B2

(12) United States Patent
Bruder

(10) Patent No.: US 7,601,047 B2
(45) Date of Patent: Oct. 13, 2009

(54) TOY VEHICLE FOR COLLECTING AND CONVEYING GARBAGE, PAPER OR THE LIKE

(75) Inventor: Paul Heinz Bruder, Fürth (DE)

(73) Assignee: Bruder Spielwaren GmbH & Co. KG, Fürth (DE)

( * ) Notice: Subject to any disclaimer, the term of this patent is extended or adjusted under 35 U.S.C. 154(b) by 569 days.

(21) Appl. No.: 11/345,329

(22) Filed: Feb. 2, 2006

(65) Prior Publication Data

US 2006/0178084 A1 Aug. 10, 2006

(30) Foreign Application Priority Data

Feb. 5, 2005 (DE) ..... 20 2005 001 823 U
Aug. 9, 2005 (DE) ..... 20 2005 012 674 U

(51) Int. Cl.
*A63H 33/30* (2006.01)

(52) U.S. Cl. ..... 446/424; 446/427; 446/431; 241/260.1

(58) Field of Classification Search ..... 446/424, 446/427, 428, 465, 431; 414/406–408, 421; 241/260.1

See application file for complete search history.

(56) References Cited

U.S. PATENT DOCUMENTS

| | | | | |
|---|---|---|---|---|
| 2,681,739 | A * | 6/1954 | Gokey | 446/428 |
| 3,764,077 | A * | 10/1973 | McCallum | 414/502 |
| 4,993,649 | A * | 2/1991 | Koenig | 241/224 |
| 5,141,387 | A * | 8/1992 | Smith | 414/735 |
| 5,391,039 | A * | 2/1995 | Holtom | 414/408 |
| 5,435,768 | A | 7/1995 | Dunleavy | |
| 6,264,528 | B1 | 7/2001 | Doan et al. | |
| 6,485,351 | B2 * | 11/2002 | Bruder | 446/427 |
| 6,494,665 | B1 * | 12/2002 | Bingman | 414/409 |

FOREIGN PATENT DOCUMENTS

| | | |
|---|---|---|
| DE | 296 10 795 U1 | 9/1996 |
| EP | 1 234 607 A1 | 8/2002 |
| EP | 1 553 030 A1 | 7/2005 |

* cited by examiner

*Primary Examiner*—Gene Kim
*Assistant Examiner*—Urszula M Cegielnik
(74) *Attorney, Agent, or Firm*—Browdy and Neimark, P.L.L.C.

(57) ABSTRACT

The invention relates to a toy vehicle for collecting and conveying garbage, paper or the like, having a collection container with charging hole, and distinguished by a collecting and emptying arrangement for a garbage can, paper can or the like.

9 Claims, 6 Drawing Sheets

TOY VEHICLE FOR COLLECTING AND CONVEYING GARBAGE, PAPER OR THE LIKE

BACKGROUND OF THE INVENTION

1. Field of the Invention

The invention relates to a toy vehicle for collecting and conveying garbage, paper or the like, comprising a collection container with a charging hole.

2. Background Art

A toy vehicle of the generic type is known for example from EP 01 101 761.3.

SUMMARY OF THE INVENTION

It is an object of the invention to create another embodiment of a toy vehicle for being charged with refuse, with the complicated hydraulic technology of a fullsize truck being copied by cinematics that can easily be operated by a playing child, producing an important overall stimulus to playing.

According to the invention, this object is attained by a collecting and emptying arrangement, comprising

- a grab which is mounted on a shaft pivotably in relation thereto;
- a grabber fork which is mounted on the free front end of the grab pivotably by approximately 90°, for enclasping a can, backing up the top rim of the can that stands out;
- an attached lever which extends downwards away from the grabber fork and, by its free end, is articulated to a control rod, the inner end of which again being articulated to a lever attachment that extends downwards away from the shaft; and
- a turning knob for the shaft to be pivoted.

Consequently, by operation of a single turning knob, it is possible to implement highly complicated motions by the grabber fork being pivoted first and then the grab together with the can.

In keeping with the invention, provision is made for a retaining projection to be mounted on the grab in such a way that, after a garbage can that must be emptied has been seized, the retaining projection encompasses the rim of the garbage can. In this way, the garbage can is held tight reliably during the pivoting process.

The grabber fork may have two arms which are parallel to, and spaced apart from, one another and the internal distance of which corresponds to the external width of the basic structure of the garbage can so that the can is positively held by the grabber arms, with the garbage can favorably having a top rim which projects laterally over the basic structure and which the grabber arms may rest on upon elevation.

A partial aspect of the invention relates to conveying equipment for refuse picked up by the grab or in any other way, the conveying equipment being characterized by feed screws which are rotarily drivable by a crank or a turning knob.

In a toy vehicle of the generic type, the feed screws are preferably disposed underneath the charging hole.

Favorably, the crank is joined to a shaft which conical gears are disposed on centrally in respectively opposite directions, the conical gears meshing with cylindrical gears that are located on the ends of shafts of the feed screws.

By advantage, the bottom areas below the feed screws are approximately concentric thereof at a distance therefrom.

In an alternative embodiment, the grabber fork of the grab may give an optical impression of enclasping the garbage can that must be emptied, however, the retaining job during the ensuing process of upwards pivoted motions is implemented by a pilot pin on the grab, with the pilot pin, behind a round seating rod, engaging with a recess, thus formed, between the round seating rod and the rim of the garbage can.

Advantageously, provision is further made for a collecting and emptying arrangement for a garbage can, paper can or the like, comprising

- a grab which is mounted on a shaft pivotably in relation thereto;
- a grabber fork which is mounted on the free front end of the grab pivotably by approximately 90° for enclasping a can, backing up the top rim of the can that projects outwards;
- an attached lever which extends downwards away from the grabber fork and, by its free end, is articulated to a control rod, the inner end of which being again articulated to a lever attachment that extends downwards away from the shaft; and
- a turning knob or a crank for the shaft to be pivoted.

This helps prevent the garbage can from dropping into the charging hole when it is emptied.

Details of the invention will become apparent from the ensuing description of a preferred exemplary embodiment, taken in conjunction with the drawing.

DESCRIPTION OF A PREFERRED EMBODIMENT

Figure 1:
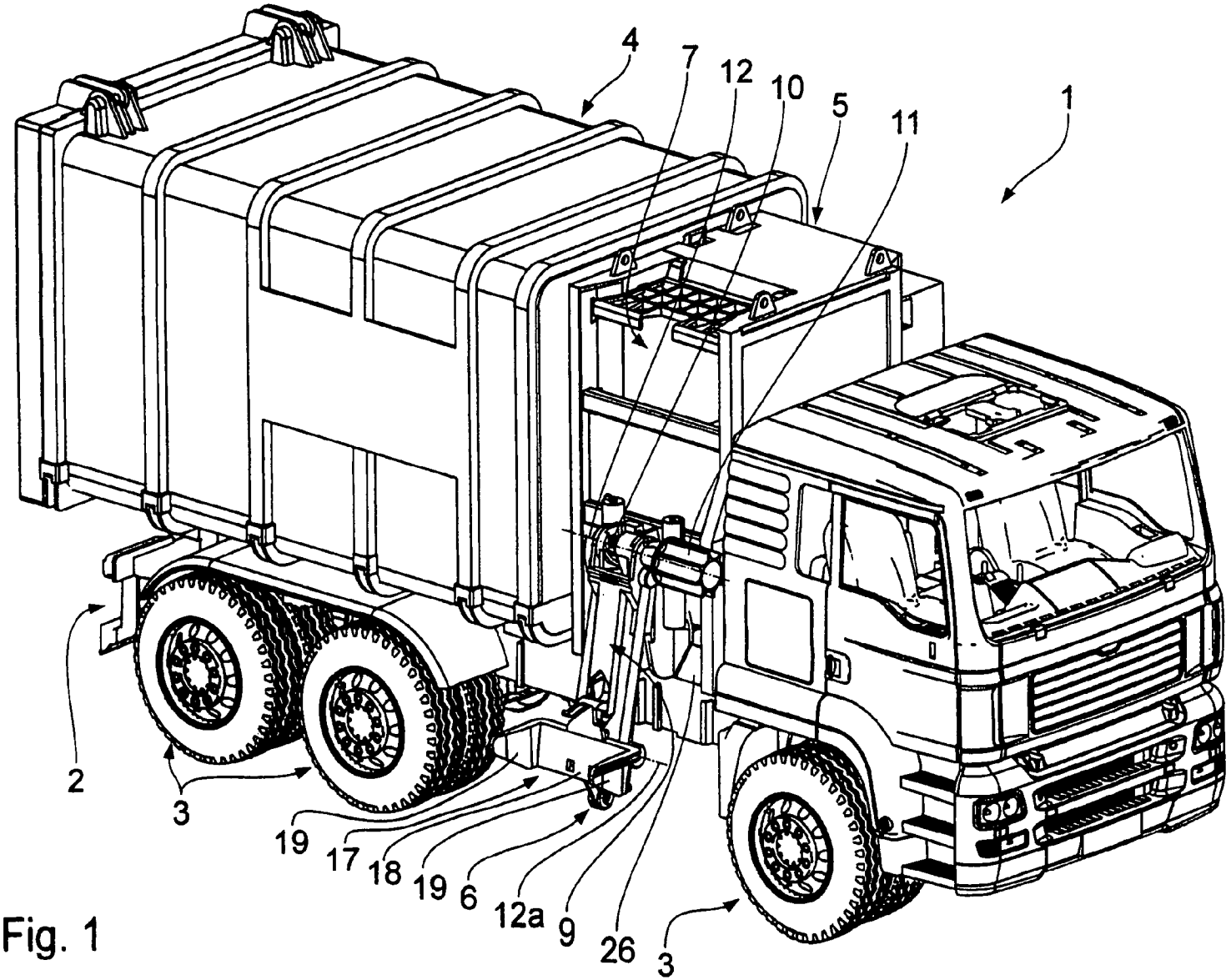
FIG. 1 is a perspective view of a vehicle according to the invention.

A toy vehicle 1 illustrated in FIG. 1 comprises a chassis 2 with six wheels 3 and a collection container 4 which is placed on the chassis 2, with a collection arrangement 5 being mounted on a face of the container 4, comprising a collecting and emptying arrangement 6 for a garbage can, paper can or the like and a charging hole 7, feed screws 32, 33 being disposed thereunder, conveying dumped refuse from the emptying area into the collection container 4.

The collecting and emptying arrangement comprises a grab 9 which is mounted on a shaft 10 pivotably in relation thereto about a horizontal axis 12, the shaft 10 being joined to a turning knob 11.

At its front end, the grab 9 has an attached lever 13 which, by way of a pivot joint 15, is connected to a control rod 14 which, in the vicinity of its top end, is connected to a lever attachment 17 by way of a pivot hinge 16 that is located on the shaft 10; the lever attachment 17 is fixed thereto and extends radially downwards therefrom.

At the front end of the grab, a grabber fork 18 is pivoted about a horizontal axis 12. The grabber fork 18 has two fork arms 19.

A garbage can 20, which must be emptied, comprises an encircling rim 21, with the distance from each other of the fork arms 19 being dimensioned for it to correspond to the width of the basic structure 22 of the garbage can 20, the fork arms 19 thus being able positively to enclasp the basic structure 22 and to back up the encircling rim 21.

The shaft 10 of the collecting and emptying arrangement 6 is mounted on a support 23 which comprises an approximately vertical portion 24 and a horizontal portion 25 that engages with a recess 26 where it is guided for sliding motion.

Figure 2:
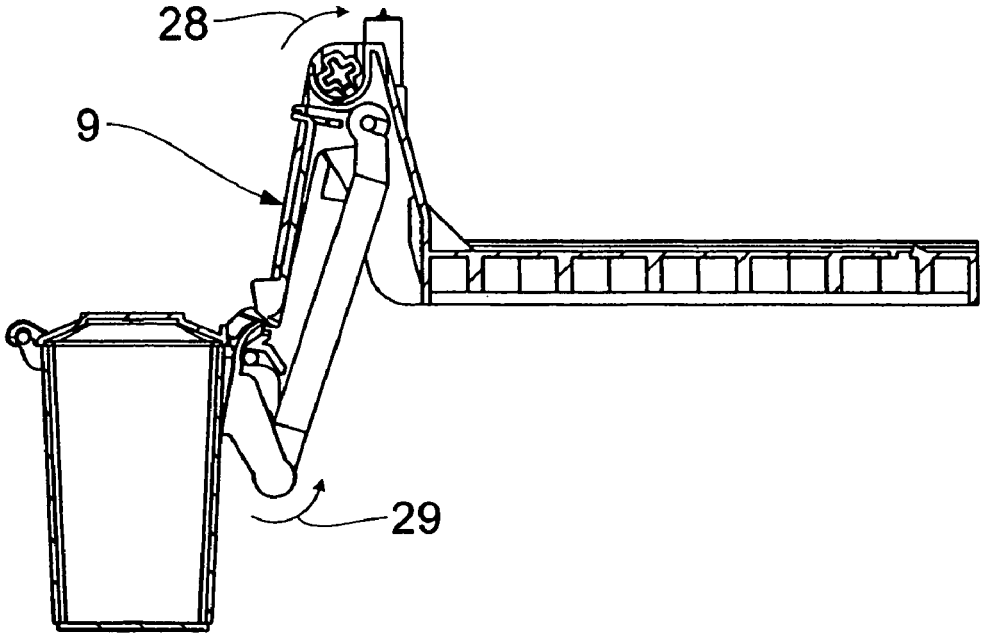
FIG. 2 is a sectional view of the grab and garbage can in the initial stage of the emptying process.

Proceeding from what has been said above, the job of emptying a can 20 takes place as follows:

The toy vehicle 1 is driven to the side of the can that must be emptied. The support 23 is extended so that, as seen in FIG. 2, the arms 19 of the grabber fork 18 of the grab 9 positively enclasp basic structure 22 of the can 20, backing up the rim 21. In the process, a retaining projection 27 of the grab 9 takes its seat above the encircling rim 21 of the can 20 so that the can 20 is fixed between the retaining projection 27 and the fork arms 19.

Figure 3:
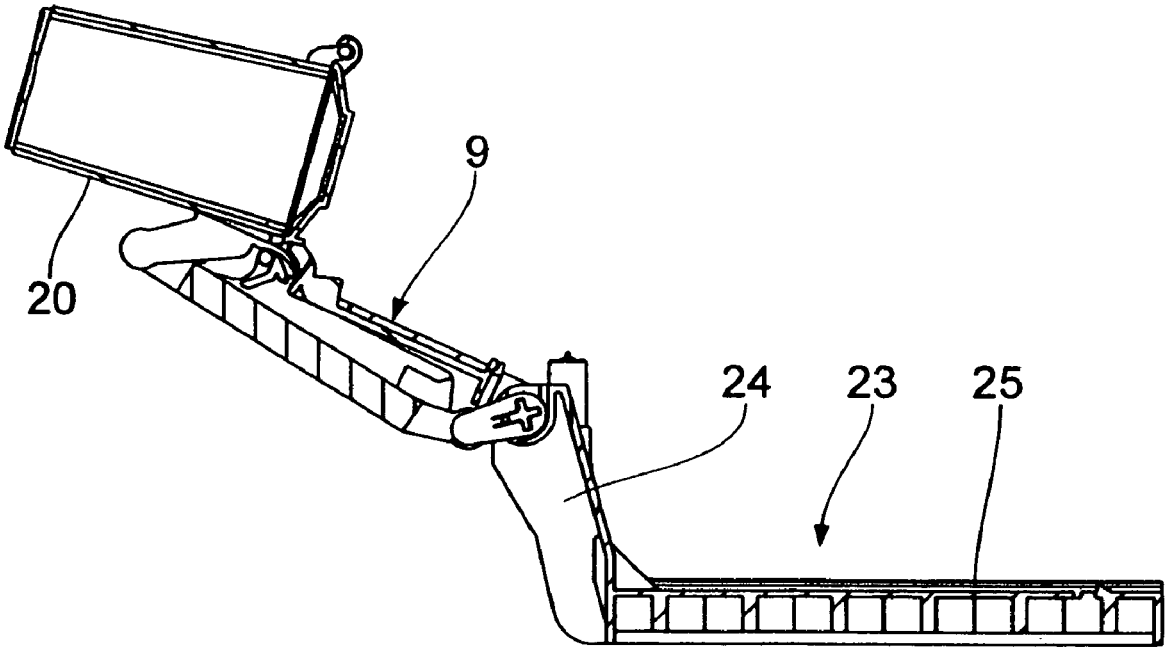
FIG. 3 is a view, corresponding to FIG. 2, in an interim stage.

Then the playing child operates the turning knob 11 in the direction of the arrow 28. In this way, the lever attachment 17 first pushes the control rod 14 forwards on the shaft 10 by way of the pivot joint 15; the control rod 14, by way of the pivot joint 15, acts on the lever attachment 17 of the grabber fork 18 that is mounted on the grab 19 pivotably about the pivoting axis 12a, pushing the grabber fork 18 in the direction of the arrow 29 by 90° upwardly backwards. As that motion continues, the control rod 14 comes to rest on the bottom side of the grab 9 so that, with the turning knob 11 being rotated further in the direction of the arrow 28, the can 20, which is then positioned approximately parallel to the grab 9, will be lifted as seen in FIG. 3.

As the pivoting motion continues, the can 20 arrives in the vicinity of the hole 7, taking a position pivoted by 180° so that the lid 31 of the can 20 can open and the contents are dumped into the collection container 4.

Two feed screws 32, 33 which are driven in opposite directions are located in the container 4 above bottom areas 34, 35 which enclose the feed screws 32, 33 at a distance from the feed screws 32, 33 and extend approximately concentrically thereof on the bottom side.

The feed screws 32, 33 have shafts 36, 37 with feed elements 38, 39.

Cylindrical gears 44, 45 are mounted on the rear end of the shafts 36, 37. A shaft 40 is located in the vicinity of the cylindrical gears 44, 45 vertically to the shafts 36,37, comprising a crank 41.

Conical gears 42, 43 are disposed on the shaft 40 in the vicinity of the cylindrical gears 44, 45, meshing therewith.

The conical gears 42, 43 are actuated upon rotation of the crank 41, acting on sides, turned towards one another, of the cylindrical gears 38, 39, thus producing rotation of the shafts 36, 37 in opposite directions and, consequently, a feed effect on the dumped refuse in a direction towards the collection container 4.

Figure 9:
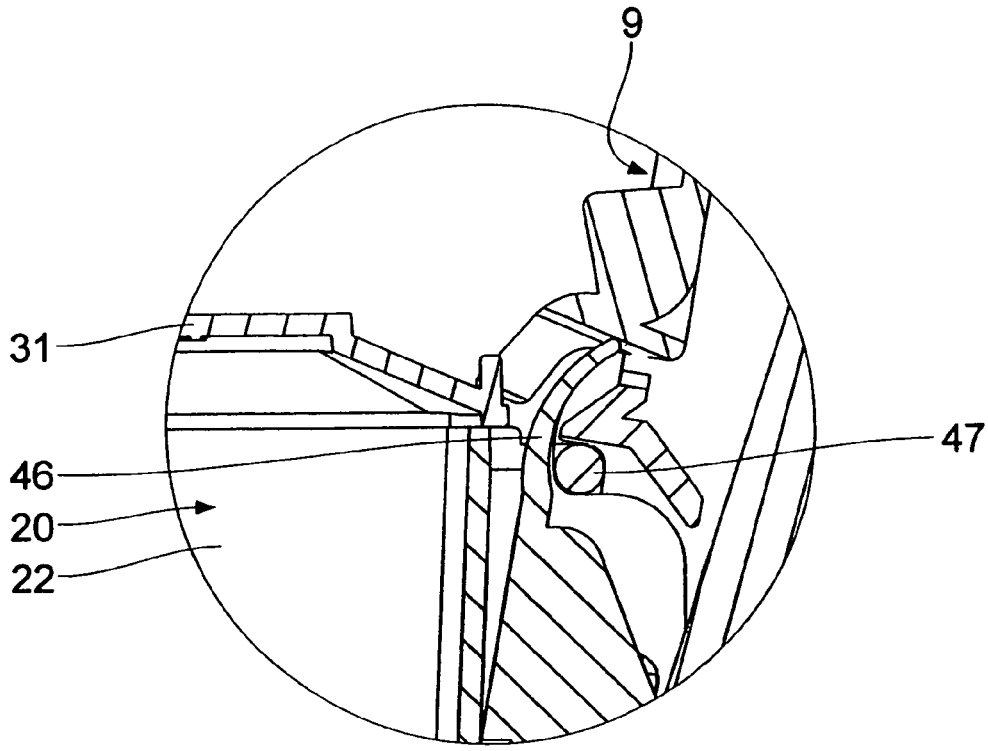
FIG. 9 is a view of the detail of FIG. 2.

By alternative of the garbage can 20 being positively seized by the grabber fork 18, provision can be made for a pilot pin 46 in the middle of the grabber fork (see FIG. 9), the pilot pin 46 backing up a round seating rod 47 on the front of the garbage can 20 (see FIG. 2 in connection with FIG. 9), with the garbage can 20 being fixed on the grab 9 by a seating stop (see FIG. 9).

As mentioned above, the grabber fork 18 is mounted pivotably about a horizontal axis 12*a*. The pivoting motion about the axis 12*a* enables the pilot pin 46 to seize the round seating rod 47 of the garbage can 20 from behind.

Figure 4:
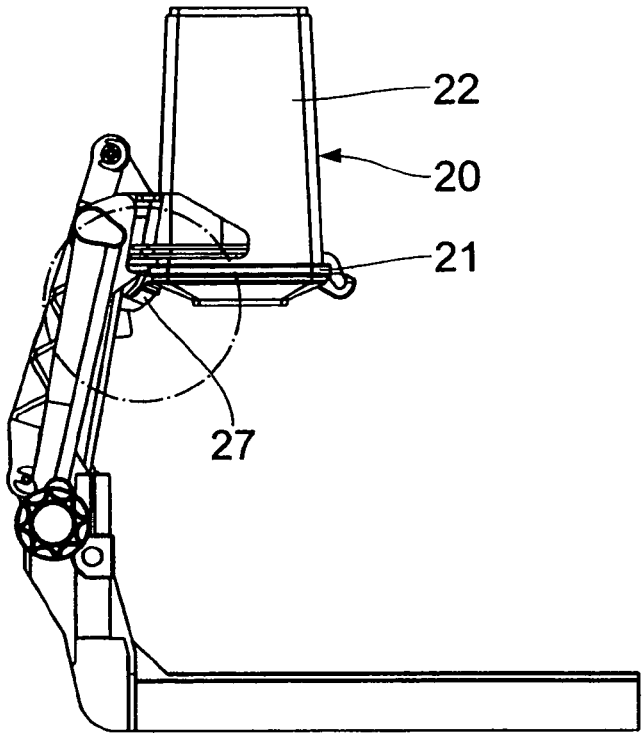
FIG. 4 is a lateral view, corresponding to FIGS. 2 and 3, in the final stage of the emptying process.
Figure 5:
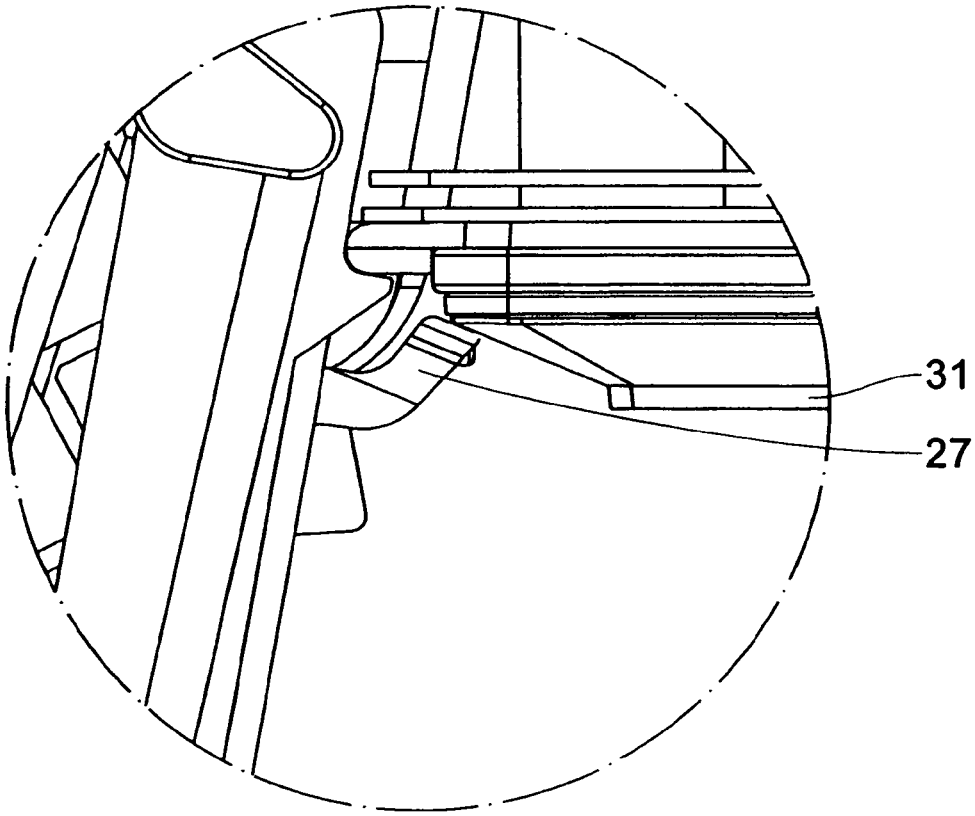
FIG. 5 is an illustration of a detail located in a circle in FIG. 4.
Figure 6:
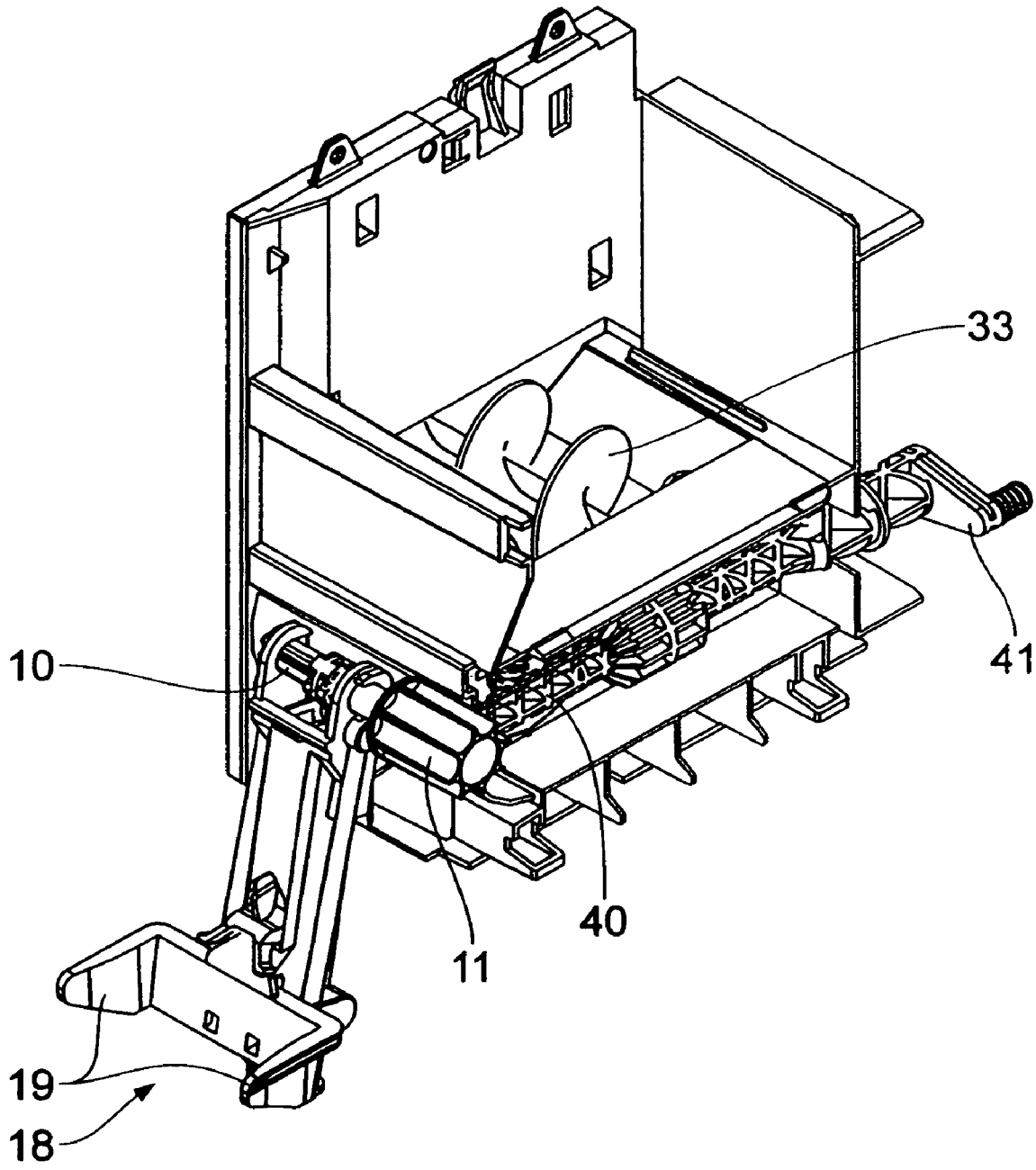
FIG. 6 is a perspective view of the open feed screw area.
Figure 7:
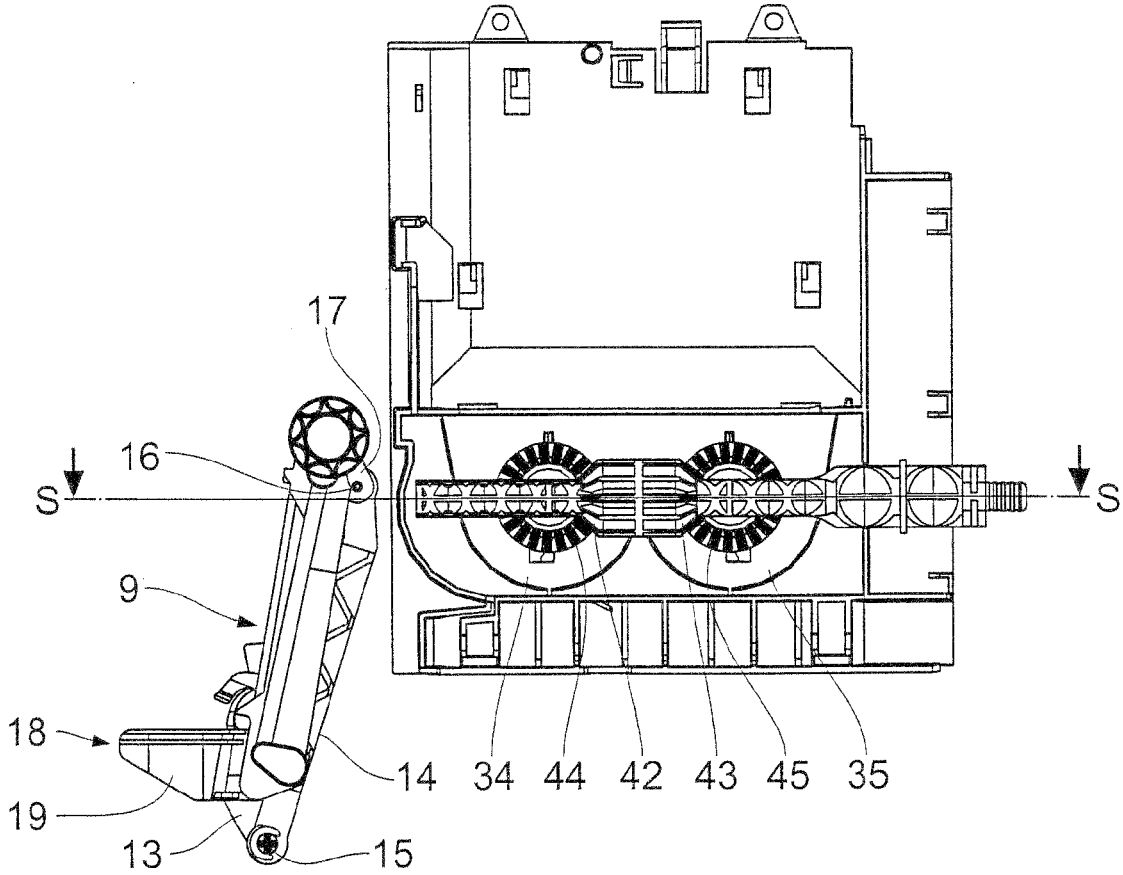
FIG. 7 is a view from behind of the feed screw area.
Figure 8:
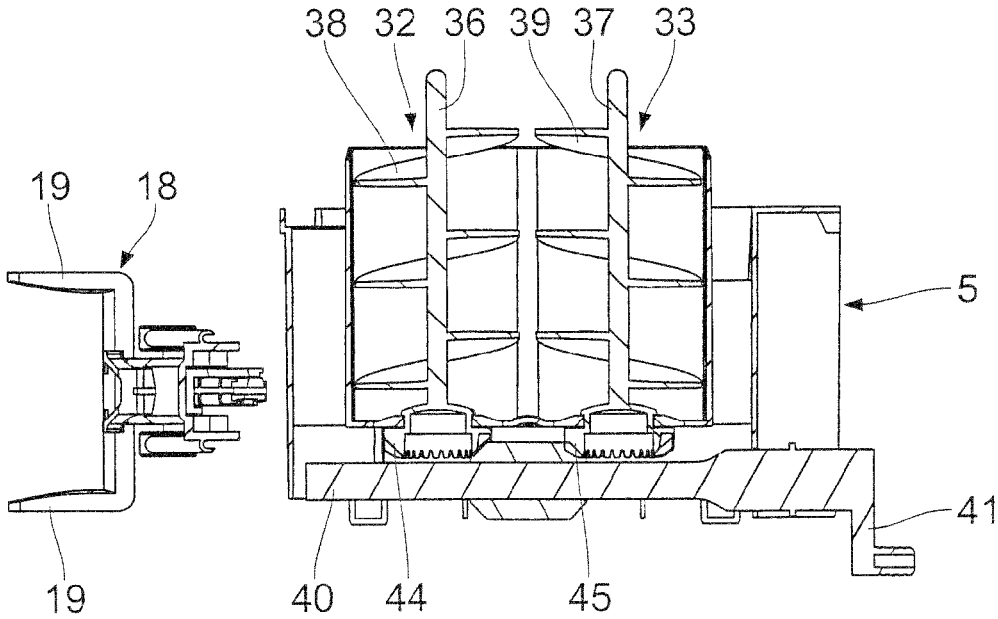
FIG. 8 is a sectional view on the line S-S of FIG. 7.

The retaining projection 27 works as a kind of flexible tongue which has the purpose of keeping the lid 31 of the can closed (see FIG. 4 and in particular FIG. 5) until the flexible tongue stops on the casing of the press and, in doing so, is pushed away from the casing; the lid 31 of the can 20 is able to open downwards only then (and not before), ensuring that the lid of the garbage can 20 only opens when the can 20 is in a position above the charging hole 7.

Lifting the can has been described above in connection with FIG. 2 and FIG. 3. In keeping with an especially advantageous embodiment, additional provision is made for the following:

The shaft 10 with the turning knob 11 is located on the top side of the vertical portion 24 of the support 23.

Figure 10:
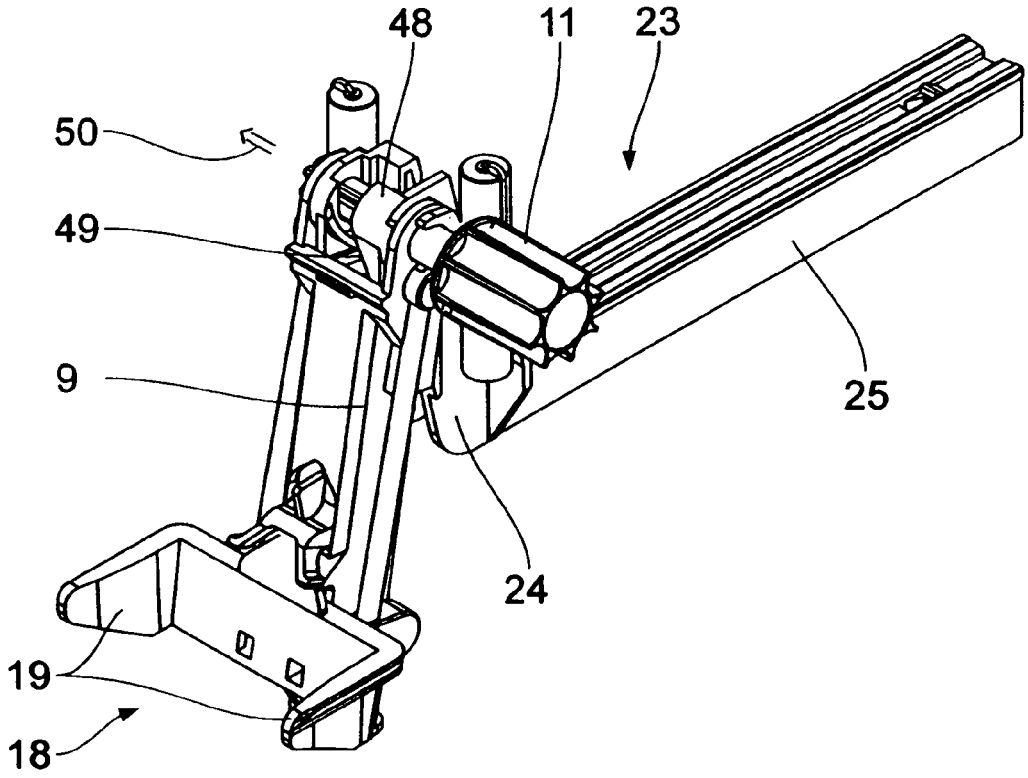
FIG. 10 is a perspective view, corresponding to FIG. 2, at an angle from above.

FIG. 10 illustrates that a link guide 48 is formed on the front side of the portion 24, having a control edge 49 which extends outwardly upwards at an angle to the left, as seen in particular in FIG. 10. When the can 20 is pivoted upwards by means of the turning knob 11, the lever attachment 17 that is seated on the shaft 10 will bear against the downward end of the control edge 49 at the end of the pivoting motion and, upon further pivoting, will be forced together with the shaft 10 to the left in the direction of the arrow 50 in FIG. 10, whereby a small pin on the lever attachment 17 engages with a bore on the retaining projection or flexible tongue 27, respectively, the parallelogram function thus being blocked and the garbage can 20 reliably fixed. In this way the garbage can 20, when emptied above the charging hole 7, is prevented from dropping into the charging hole 7 because, during the backward motion of the mechanism, the pilot pin 44 is first retracted, the can 20 then being no longer fixed.

What is claimed is:

1. A toy vehicle for collecting and conveying garbage, paper or the like, having a collection container with a charging hole, distinguished by a collecting and emptying arrangement (6) for a garbage can, paper can or the like, comprising a grab (9) which is mounted on a shaft (10) pivotably in relation thereto;

a grabber fork (18) which is disposed on a free front end of the grab (9) pivotably by approximately 90°, for enclasping a can (20) and backing up a top rim (21) thereof that stands out;

an attached lever (13) which extends downwards away from the grabber fork (18) and, by its free end, is articulated to a control rod (15), the inner end of which is articulated to a lever attachment (17) that extends downwards away from the shaft (10);

a turning knob (11) or a crank for the shaft (10) to be pivoted; and a retaining projection (27) that is disposed on the grab (9) in such a way that, after a garbage can (20) that must be emptied has been seized, the retaining projection (27) encompasses the rim (21) of the garbage can (20) so that the can (20) is fixed between the retaining projection (27) and the arms (19) of the grabber fork (18) and the retaining projection (27) keeps a lid (31) of the can (20) closed.

2. A toy vehicle according to claim 1, wherein the grabber fork (18) has two arms (19) which are parallel to one another and disposed at a distance from one another, the internal distance of the arms (19) corresponding to the external width of a basic structure (22) of the garbage can (20).

3. A toy vehicle according to claim 2, wherein the garbage can (20) has a top rim (21) which stands out laterally from the basic structure (22).

4. A toy vehicle according to claim 1, wherein, for conveyance of refuse into the collection container (4), feed screws (32, 33) are provided, which are rotatably drivable by way of a crank (41) or a turning knob (11).

5. A toy vehicle according to claim 4, wherein the feed screws (32, 33) are disposed underneath the charging hole (7).

6. A toy vehicle according to claim 4, wherein the crank (41) is joined to a shaft on which conical gears (42, 43) are centrally disposed in a respectively opposite direction, meshing with cylindrical gears (38, 39) which are seated on the ends of shafts (36, 37) of the feed screws (32, 33).

7. A toy vehicle according to claim 6, wherein the bottom areas (34, 35) underneath the feed screws (32, 33) extend approximately concentrically thereof at a distance therefrom.

8. A toy vehicle for collecting and conveying garbage, paper or the like, having a collection container with a charging hole, distinguished by a collecting and emptying arrangement (6) for a garbage can, paper can or the like, comprising a grab (9) which is mounted on a shaft (10) pivotably in relation thereto;

a pilot pin (46) for grasping the garbage can (20), seizing a round seating rod (47) of the garbage can (20) from behind, wherein the pilot pin (46) is attached in the middle of a grabber fork (18) as a part of the grab (9);

an attached lever (13) which extends downwards away from the grabber fork (18) and, by its free end, is articulated to a control rod (14), the inner end of which is again articulated to a lever attachment (17) that extends downwards away from the shaft (10); and a turning knob (11) or a crank for the shaft (10) to be pivoted.

9. A toy vehicle for collecting and conveying garbage, paper or the like, having a collection container with a charging hole, distinguished by a collecting and emptying arrangement (6) for a garbage can, paper can or the like, wherein a link guide (48) is provided, having a control edge (49) which the lever attachment (17) that is joined to the shaft (10) will bear against when the turning knob (11) is pivoted, so that the lever attachment (17) and the shaft (10) make a translatory sidewise motion whereby a pin on the lever attachment (17) engages with a bore on the retaining projection (27), thus blocking the parallelogram function and fixing the garbage can (20), and wherein the retaining projection (27) of a grab (9) takes its seat above an encircling rim (21) of the can (20) so that the can (20) is fixed between the retaining projection (27) and arms (19) of the grabber fork (18) and the retaining projection (27) keeps a lid (31) of the can (20) closed.

* * * * *